United States Patent [19]

Lafferty

[11] 4,349,121

[45] Sep. 14, 1982

[54] CASE WITH HINGED LID ASSEMBLY

[75] Inventor: James Lafferty, Erie, Pa.

[73] Assignee: Rehrig Pacific Corporation, Los Angeles, Calif.

[21] Appl. No.: 232,629

[22] Filed: Feb. 9, 1981

[51] Int. Cl.[3] ..... B65D 43/14; B65D 51/04

[52] U.S. Cl. ..... 220/341; 220/337

[58] Field of Search ..... 220/334, 337, 338, 341; 206/503, 508; 16/128

[56] References Cited

U.S. PATENT DOCUMENTS 2,990,082 6/1961 Boysen ..... 220/338
3,315,796 4/1967 Dreyfuss ..... 220/337
3,655,088 4/1972 Box ..... 220/337
3,998,327 12/1976 Box ..... 206/508

*Primary Examiner*—George T. Hall
*Attorney, Agent, or Firm*—Schuyler, Banner, Birch, McKie & Beckett

[57] ABSTRACT

The present invention is directed to a case with a rotatable and readily removable cover. The unitary flexible cover is provided with hinge members adapted to cooperate with corresponding slots in an upstanding wall of the case upon manual flexing of the cover. Upon release of the cover, the cover returns to its normally flat posture, locking the cover in place through means of tabs. A preferred embodiment comprises a plastic beer case.

7 Claims, 5 Drawing Figures

CASE WITH HINGED LID ASSEMBLY

BACKGROUND OF THE INVENTION

1. Field of the Invention

The present invention relates to carrying and stacking cases of the type generally used for storage and transportation of beverage bottles, especially beer bottles. In particular, the present invention relates to such cases that are equipped with lids or covers.

2. State of the Prior Art

Cases of the foregoing type equipped with covers are in common use. Many are produced by molding in a single operation from a suitable high impact plastic, such a polyethylene, polypropylene, polyvinyl chloride and the like.

In use it is often desirable to close the top of the cases. Closable containers protect bottled products from light, dirt and dust, the impact of objects that might fall onto the cover, and may facilitate stacking the cases, depending on the design of the case and lid.

The prior art illustrates several methods of hingeably attaching a cover or lid to a case. It is, for example, well known to construct such a case from cardboard wherein the fold in the cardboard along the edge of the case serves as a hinge. Cases of this type are subject to rapid deterioration due to the repeated bending of the cardboard hinge. In addition, they are susceptible to damage from water. As indicated above, various plastics have gained widespread acceptance in the manufacture of beverage bottle cases. Suitably attaching a hinged lid to such cases, however, presents difficulties that have not been altogether overcome by the prior art. Crate, (Canadian Pat. No. 703,687) for example, teaches a two-piece lid with a series of pivot shaft 13 constructed of metal held in place by shaft supports 14 which may be mounted on either the case or the lid. The other half of the hinge comprises two types of pivot shaft engaging means 15, 17 which enable the lid to be readily snap-fitted onto, or removed from, the case. This construction suffers from the disadvantage that it requires two different materials, and therefore cannot be manufactured in one step. In addition, the pivot shaft may be subject to corrosion, which shortens the life of the case, and may impede operation of the hinge. Second, the hinge is positioned exactly along the top edge of the case an protrudes above the body of the case. In this position the hinge, which is probably the weakest portion of the structure, is directly exposed to the weight of cases that may be stacked on it, and to the impact that may result when the cases accidentally bump into another object. In addition, the hinge and the individual pivot shaft engaging means are the weakest portions of the entire structure and are accordingly most susceptible to breakage and damage.

Other prior art, for example, Dreyfuss, U.S. Pat. No. 3,315,796, and Boysen, U.S. Pat. No. 2,990,082, provide hinge pintles integral with the cover element that engage in pintle receiving spots. In Boysen, the cover 11 is permanently attached and cannot be removed without damaging the cover and the case. Thus if either member of the unit is damaged, the entire unit must be discarded. In addition, Boysen requires a hollow-spaced double wall as a housing for its hinge. Dreyfuss provides hinges 84 at the bottom of the case. This construction limits the strength of the joint between the bottom wall and hinged sidewall to the strength of the hinge pintles. When cases are stacked, it is this joint that should be strongest. The hinge of Dreyfuss is not readily adaptable to being repositioned along the top of a vertical wall.

SUMMARY OF THE INVENTION

Thus, it would be of significant importance if a case, such as a beer case, could be provided with a cover that could be readily opened and closed, removed, and replaced without the use of tools, and would be sturdy, non-corrosive, and interfere less with the structural integrity and strength of the case.

It is a general object of the present invention to provide a hinged cover assembly for a case that overcomes the deficiencies of the prior art.

More specifically, it is an object of the present invention to provide a beverage case with a hinged cover assembly that can be readily removed and replaced without the use of tools, but which will not become inadvertently disengaged from the case. This feature makes cleaning the case easier. It also facilitates filling or emptying the case in confined areas such as narrow isles.

It is a further object of the present invention to provide a beverage case and cover made entirely of one material which is non-corrosive.

It is an object of the present invention to provide a beverage case with a hinged cover assembly that is simple and inexpensive to manufacture.

It is also an object of the present invention to provide a beverage case and hinged cover assembly in which the case or the hinged cover assembly may be individually and separately replaced in the event of damage to either.

It is also an object of the present invention to provide a beverage case and hinged cover assembly in which, in the closed position, the hinge is flush with the body of the case for ease of stacking and handling.

It is also an object ov the present invention to provide a beverage case and hinged cover assembly in which the structural integrity and strength of the case walls are substantially maintained.

Accordingly, the present invention provides a plastic case comprising in combination, at least one upstanding wall having at least one hinge receiving slot, at least one separate unitary flexible cover comprising hinge means adapted to be retained in said slot when said cover is unflexed to allow pivotal movement of said cover with respect to said wall, said cover attachable to said wall upon flexing of said cover to cause said hinge means to enter said slot, wherein said cover is retained in said slot in a pivotal state upon release of said cover to an unflexed condition.

BRIEF DESCRIPTION OF THE DRAWINGS

Other features and objects of the invention will become apparent in the following description, claims and drawings in which:

DETAILED DESCRIPTION OF THE INVENTION

The invention relates to a case and hinged lid assembly. The case may be integrally molded of high impact plastic such as polyethylene, polypropylene, polyvinyl chloride or other suitable material. The separate cover may be integrally molded of a flexible plastic such as polyethylene, polypropylene, polyvinyl chloride or other suitable material.

The body of the case comprises one set of opposed upstanding side walls, a second set of upstanding end vertical walls, and a bottom wall, wherein at least one upstanding wall is adapted to receive each of the hinge members through corresponding slots. The case may be equipped with suitable reinforcing segments and compartment dividers. Except for the portion of the upstanding wall containing the hinge slots and slot extensions, the specific details of the design of the case form no part of the invention and will not be discussed further.

Figures 1, 5:
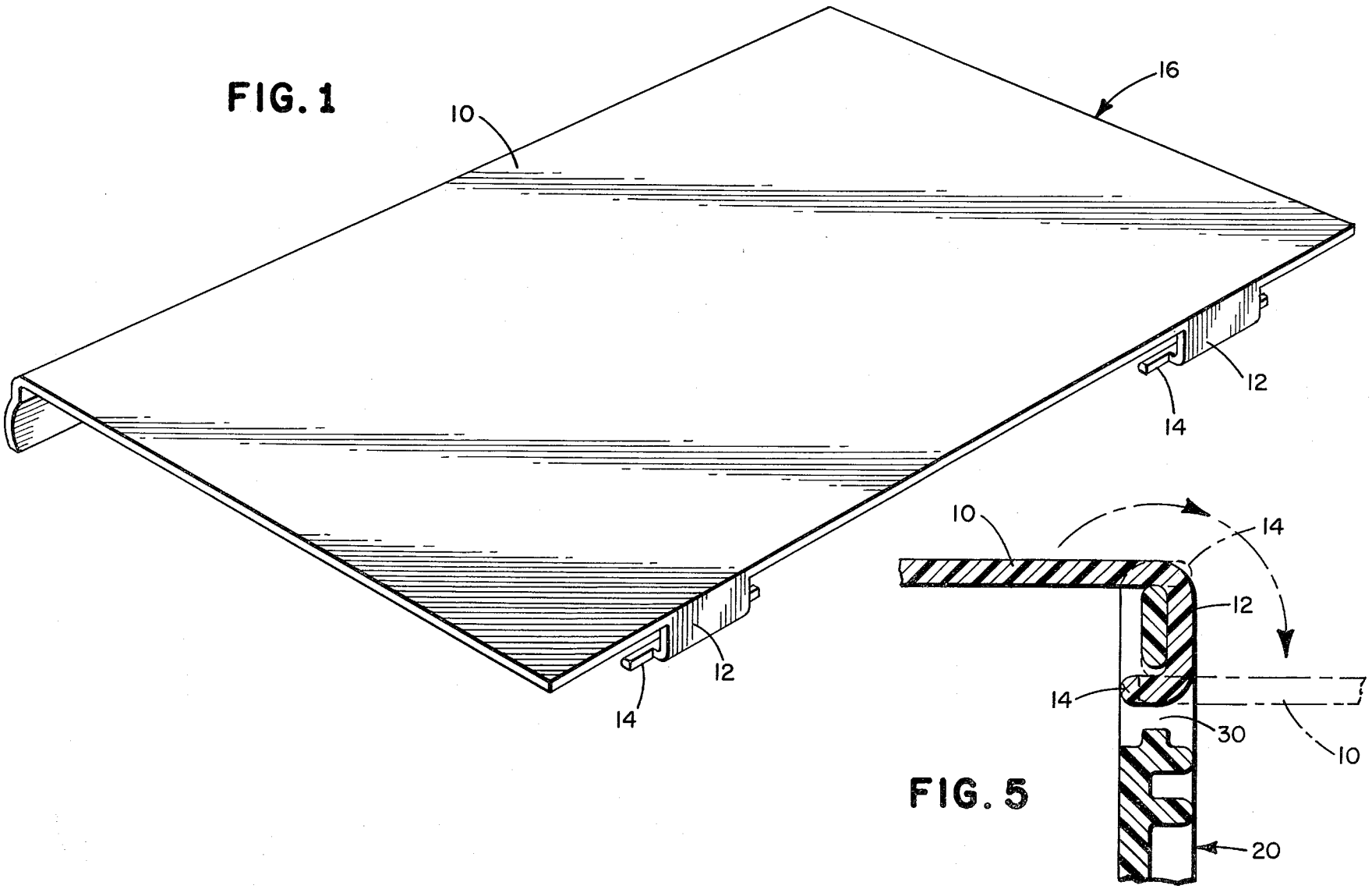
FIG. 1 is an isometric view of a cover and hinge assembly according to the present invention.
FIG. 5 is a sectional view taken along lines 5—5 of FIG. 1.
Figure 4:
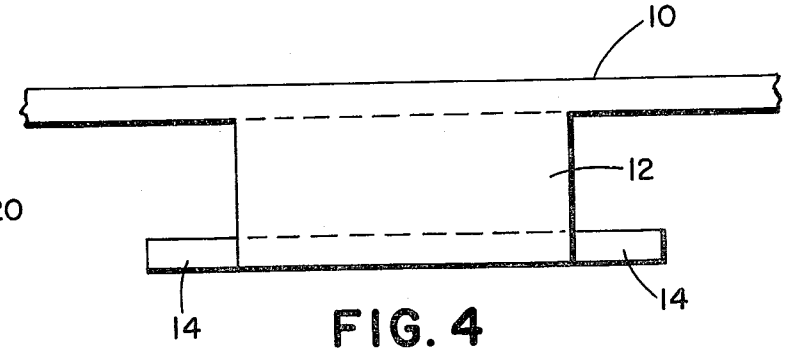
FIG. 4 is a front vertical elevation of the hinge member of FIG. 1.

Referring to FIG. 1, the cover 16 comprises a lid portion 10, and hinge members 12. Each hinge member 12 further comprises a tab from the cover having a first portion of first width and a second outer portion 14 of second, larger width. The entire cover 16 including hinge members 12 may be integrally molded from one flexible material, such as polyethylene. Although flexible, the cover 16 must also be resilient, tough and strong. Lid portion 10 may be substantially rectangular and adapted to cover substantially the entire surface area of the container to which it is intended to be affixed. In a preferred embodiment, cover 16 consists of two individually hinged cover portions, each covering substantially one-half the area of the case top. Hinge members 12 having a first width, extend perpendicularly downwardly from their position adjacent one edge of the cover 16, then turned inwardly at a substantially perpendicular angle so that outer portion 14 of second width of hinge members 12 is substantially parallel to lid portion 10. As best illustrated in FIG. 4, the second larger width of the hinge member 12 that is in excess of the first width of hinge member 12 is symmetrically distributed on both sides of the first width of hinge member 12.

Figure 3:
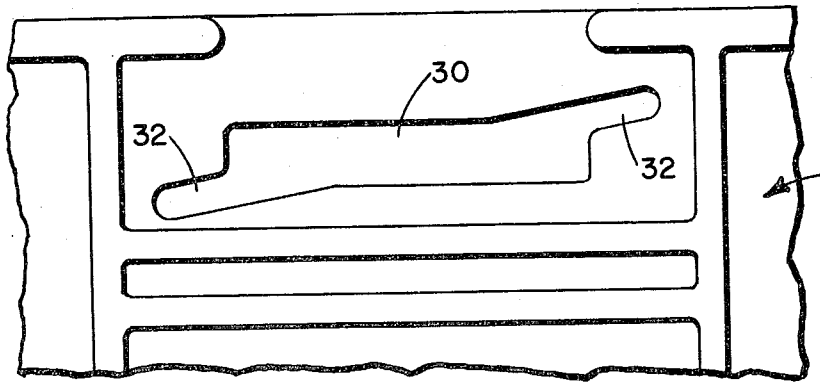
FIG. 3 is an enlarged view of the hinge receiving slot of FIG. 2.

Hinge receiving slots in a vertical wall of the case are adapted to receive each hinge member 12. Referring to FIG. 3, the hinge receiving slot is composed of a horizontal slot 30, and superimposed on it slot extensions 32 canted to the horizontal. Horizontal slot portion 30 is wide enough to receive hinge member 12 with first width, but too narrow to receive the second width. Slot extensions 32 are wider than horizontal slot 30 and may be canted at any angle of approximately 30° to the horizontal axis of horizontal slot 30. Slot extensions 32 are sufficiently wide to receive the second width of hinge members 12.

Figure 2:
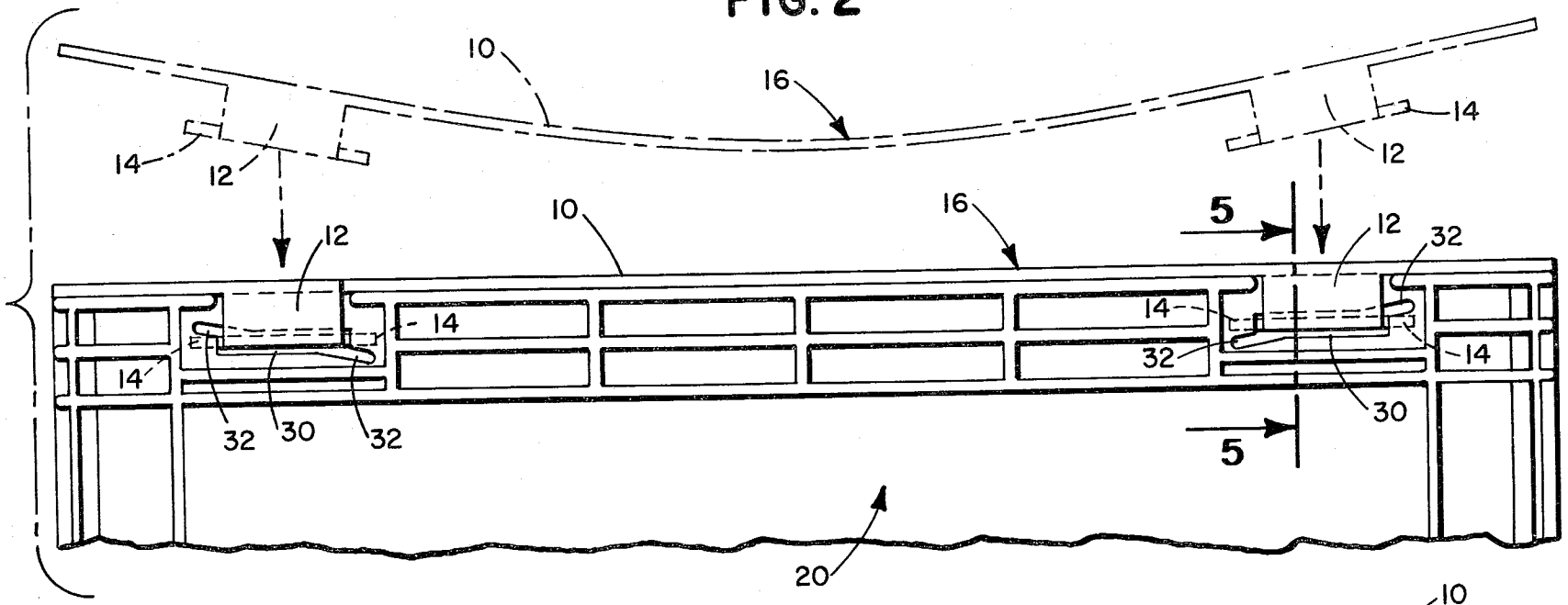
FIG. 2 is a front vertical elevation of the hinge receiving slot of an upstanding wall of a case, also illustrating the insertion position of the cover.

Installation of cover 16 in case 20 is readily achieved without the use of tools or skilled labor. The cover 16 is manually grasped along the edges of the width dimensions with hinge members 12 facing downwardly in approximately the same plane as the upstanding wall of container 20 in which hinge receiving slots 30 are molded. As illustrated in FIG. 2, cover 16 is then deformed by bending so that it is downwardly convex at its center. The cover is thus deformed until the second width of hinge members 12 align with slot extensions 32. Then hinge members 12 are inserted into slot extensions and penetrate the upstanding wall of case 20. Tab receiving slot extensions 32 of FIG. 2 are each canted at an angle to the horizontal such that they define a line running downwardly toward the vertical center line of the panel in which they are molded, thus assuring that a single downward deflection along the center line of cover 16 will bring both hinge members 12 into alignment with tab receiving slot extensions 32. After inserting the second width of hinge means 12 through tab receiving slot extensions 32 the cover 16 is released. When released, the cover returns to its normally flat configuration due to its natural resiliency. In this position, the second widths of hinge members 12 are substantially parallel to the top edge of the upstanding wall through which they were inserted. The hinge members 12 are thus aligned with and parallel to horizontal slot portion 30. The second width is wider than horizontal slot 30, which prevents hinge members 12 from inadvertently disengaging from case 20.

To remove the cover 16 from the case 20 it is necessary to reverse the steps of the above procedure. One grasps the width edges of the cover and bends it downwardly in its center until the second width of hinge members 12 align with tab slot extensions 32 and then pushes the cover 16 outwardly from case 20 until tabs 14 disengage from case 20.

In a preferred embodiment, two opposing vertical walls of case 20 include hinge receiving slots. Two individually hinged covers 16, each covering substantially one-half the area of the top of case 20 may be fitted onto the case 20 through interaction of hinge members 12 and hinge receiving slots. Construction of hinge and slot features, installation, removal and operation of the hinged lid assembly is the same whether the case includes one hinged cover or two hinged covers.

In operation, the cover 16 is rotated upwardly through angles of $180\frac{1}{4}$, i.e., when completely opened, the cover 16 is substantially perpendicular to the upstanding wall having hinge receiving slots. No bending of hinge members 12, or rotation about a fixed hinged pin is involved. Rather, the hinge members 12 slide through horizontal slot portion 30. To close the cover 16 one merely rotates the cover toward the top of case 20 which causes hinge member 12 to slide outwardly through horizontal slot 30 permitting the cover 16 to close.

Hinge receiving slots 30 and slot extension 32 are molded into a recessed area 36 of case 20, which is sufficiently recessed so that when the cover 16 is closed, hinge members 12 are flush with the exterior surface of upstanding wall of the case 20. This construction minimizes the risk of damage to the hinge members. It also serves to maintain the structural integrity and strength of the case 20 by reducing the load bearing demands placed on the hinge members themselves, and thus overcomes a primary weakness of conventional cases, which expose the hinges to a greater risk of accidental damage by placing them along a top edge of the case.

The invention has been described above in reference to specific preferred embodiments. It will be evident, however, that variations and modifications may be made without departing from the broader scope and spirit of the invention as set forth in the claims. The specification and drawings are accordingly to be regarded as illustrative rather than restrictive.

I claim:

1. A case comprising in combination:

at least one upstanding wall having at least one hinge receiving slot;

at least one separate unitary flexible cover including a hinge member comprising a tab projecting from said cover, said tab having a first portion of a first width and a second outer portion of second larger width;

said slot comprising a first slot portion of sufficient width to admit only the first portion of said tabs and a second wider slot portion forming slot extensions of sufficient width to admit the second portion of said tab;

said second tab portion adapted to be retained in said slot when said cover is unflexed to allow pivotal movement of said cover with respect to said wall, said cover attachable to said wall upon flexing of said cover to cause said second tab portion to enter said second slot portion, wherein said cover is retained in said slot in a pivotal state upon release of said cover to an unflexed condition.

2. A plastic case comprising in combination:

at least one separate unitary flexible integrally molded plastic cover comprising spaced hinge members positioned adjacent one edge of said cover, each hinge member comprising a tab projecting from said cover, said tab having a first portion of first width and a second outer portion of second larger width;

an integrally molded container comprising a first set of opposed upstanding side walls, a second set of opposed upstanding end walls, and a bottom wall, at least one of said upstanding walls having slots, each of said slots adapted to receive one of said tabs;

said slots comprising a substantially horizontal portion of sufficient width to admit said first portion of said tabs, and wider slots portions forming slot extensions of sufficient width to admit said second portions. said slot extensions being canted at an angle with respect to said horizontal slot portions;

said tab portions cooperating with said slot portions so as to be retained in said slot portions when said cover is unflexed to allow pivotal movement of said cover with respect to said upstanding wall, said cover attachable to said upstanding wall upon flexing of said cover to cause said second portions to enter said slot extensions wherein said cover is retained by said first portions in a pivotal state upon release of said cover to an unflexed condition.

3. The case of claim 2 wherein said cover can be pivotally moved between an opened and closed position, said cover positioned substantially parallel to said bottom wall when in said closed position; and said cover positioned substantially parallel to said bottom wall when in said open position.

4. The case of claim 3 wherein said slots are recessed into said one upstanding wall sufficiently that said first portions of said hinge members are flush with the exterior surface of said upstanding wall when said cover is in its closed position.

5. The case of claim 1 or 2 wherein said one upstanding wall has two slots and two corresponding slot extensions, and said cover has two hinge members.

6. The case of claim 2 wherein both of said upstanding side walls include said slots; and said case includes two said separate unitary flexible integrally molded plastic covers each having said hinge members.

7. The case of claim 1 wherein said slot is recessed into said one upstanding wall sufficiently that said first portion of said hinge member is flush with the exterior surface of said upstanding wall when said first portion is facing downwardly and said cover is perpendicular to said one upstanding wall.

* * * * *